US006003163A

United States Patent [19]

Celeste

[11] Patent Number: 6,003,163

[45] Date of Patent: Dec. 21, 1999

[54] POOL SKIMMER VACUUM ADAPTOR

[76] Inventor: Joseph Celeste, 1821 Underwood Rd., Gambrills, Md. 21054

[21] Appl. No.: 09/239,661

[22] Filed: Jan. 29, 1999

Related U.S. Application Data

[60] Provisional application No. 60/073,865, Feb. 4, 1998.

[51] Int. Cl.[6] ..... F16K 3/02

[52] U.S. Cl. ..... 4/496; 4/490

[58] Field of Search ..... 4/490, 496

[56] References Cited

U.S. PATENT DOCUMENTS 4,725,352 2/1988 Haliotis ..... 210/169

*Primary Examiner*—Gerald A. Michalsky

*Attorney, Agent, or Firm*—Brown, Pinnisi & Michaels, P.C.

[57] ABSTRACT

An adaptor for a pool vacuum hose, which fits over a suction opening in the skimmer well of a swimming pool. The adaptor creates a watertight seal against walls of a skimmer well and has a port that extends upward from a base such that a typical pool vacuum can be connected to the adaptor. The adaptor thus allows for easy connection to a vacuum hose and prevents large particles and debris from reaching the filter. When use of the vacuum is complete, an outer housing is rotated, breaching the watertight seal, and allowing easy removal of the adaptor. The adaptor is readily usable with typical swimming pool skimmer wells.

6 Claims, 4 Drawing Sheets

POOL SKIMMER VACUUM ADAPTOR

REFERENCE TO PROVISIONAL APPLICATION

This application claims an invention which was disclosed in Provisional Application Ser. No. 60/073,865, filed Feb. 4, 1998, and entitled "Pool Skimmer Vacuum Adaptor". The benefit under 35 USC §119(e) of the United States provisional application is hereby claimed, and the aforementioned application is hereby incorporated herein by reference.

FIELD OF THE INVENTION

This invention relates to an adaptor for a pump intake for a pool, and in particular, to an adaptor, capable of attachment to a swimming pool vacuum hose, that fits into a swimming pool skimmer well.

BACKGROUND OF THE INVENTION

Water in swimming pools must be mechanically filtered in order to be kept free of dirt and debris. To this end, pools have pumps that circulate water through a filter. A skimmer removes debris and large particles from the pool water prior to pumping the water to the filter. The skimmer is typically a well mounted on the side of the pool, with a filter intake at the bottom, having a plastic bucket with openings small enough to strain out leaves, hair, and other large particles without inhibiting the flow of water to the filter. The bucket is usually removable and accessible through a cover located near the pool. Water from the pool usually enters the skimmer well through a weir located at the water line on a lateral wall of the pool. Once water passes into the skimmer well, it flows through the filter intake and enters a pipe that leads to the filter. Since water is actively drawn into the filter intake by a pump, a suction is created at the opening of the filter intake.

Pool vacuums typically consist of a plastic or vinyl hose that fits into the filter intake at the bottom of the skimmer well, after removal of the bucket. Pool vacuums use the suction of the filter intake to remove dirt and debris that have settled to the bottom of the pool.

Unfortunately, when the pool vacuum is used in the manner described above, the debris and particles vacuumed from the bottom of the pool bypass the skimmer and are pumped directly into the filter. Since the filter is primarily designed to remove small particles from the pool water, the presence of the debris and large particles vacuumed from the pool bottom is undesirable. Debris often causes obstructions in the filter line and/or reduces the porous membrane area available for filtration. These conditions both place additional load on the filter pump, and decrease the useful life of the filter itself The prior art teaches complicated and aesthetically displeasing attempts at simultaneous skimming and vacuuming. For instance, in Haliotis, U.S. Pat. No. 4,725,352, a vacuum-skimmer regulator assembly is disclosed that allows for the simultaneous skimming and vacuuming of a pool. However, the invention is a complex and specialized unit and does not allow for the use of the existing pool skimmer. In addition, the vacuum port is not easily accessible, making it difficult to connect and disconnect the vacuum hose. Finally, the invention uses two skimmers within the assembly, an approach inherently more cumbersome to clean and maintain.

If a simple plate with a hose connection is placed over the skimmer basket, a vacuum hose can be used to vacuum, with the debris being caught by the skimmer basket. This is preferable to dumping the debris into the filter, but is awkward to use because the strong suction of the pool filter makes it very difficult to remove the hose when one is done vacuuming. It is necessary to shut down the filter pump to break the suction, disconnect the hose, and then restart the pump. This is a nuisance, and otherwise undesirable.

SUMMARY OF THE INVENTION

The present invention provides an adaptor that fits over the skimmer well of a swimming pool, allowing the vacuum hose to be used to remove dirt and debris without the removal of the skimmer basket. The adaptor creates a watertight seal over the skimmer well, held in place by the suction of the pool pump, and allows for easy connection to a pool vacuum hose. When use of the vacuum is complete, an outer housing is rotated, creating openings in the adaptor which breach the watertight seal, releasing the suction of the pump, and allowing the adaptor to be easily removed.

DESCRIPTION OF THE PREFERRED EMBODIMENT

The adaptor has a base which fits into a pool skimmer over the skimmer well, in the form of a body with a closed side and walls which fit flush against sides of the skimmer well, creating a watertight seal with the walls of the well. This arrangement preserves the suction of a filter intake and allows the skimmer to remain in place while the pool is vacuumed. The adaptor has two modes, open and closed. When closed, the only path available to water flowing into the filter intake is through a vacuum port extending upward from the skimmer well. Since this is much smaller than the well, the suction of the pool pump holds the base tightly against the well. When in an open mode, the watertight seal is breached because water is able to flow in through openings in the adaptor base, and the adaptor may be easily removed.

Figure 1:
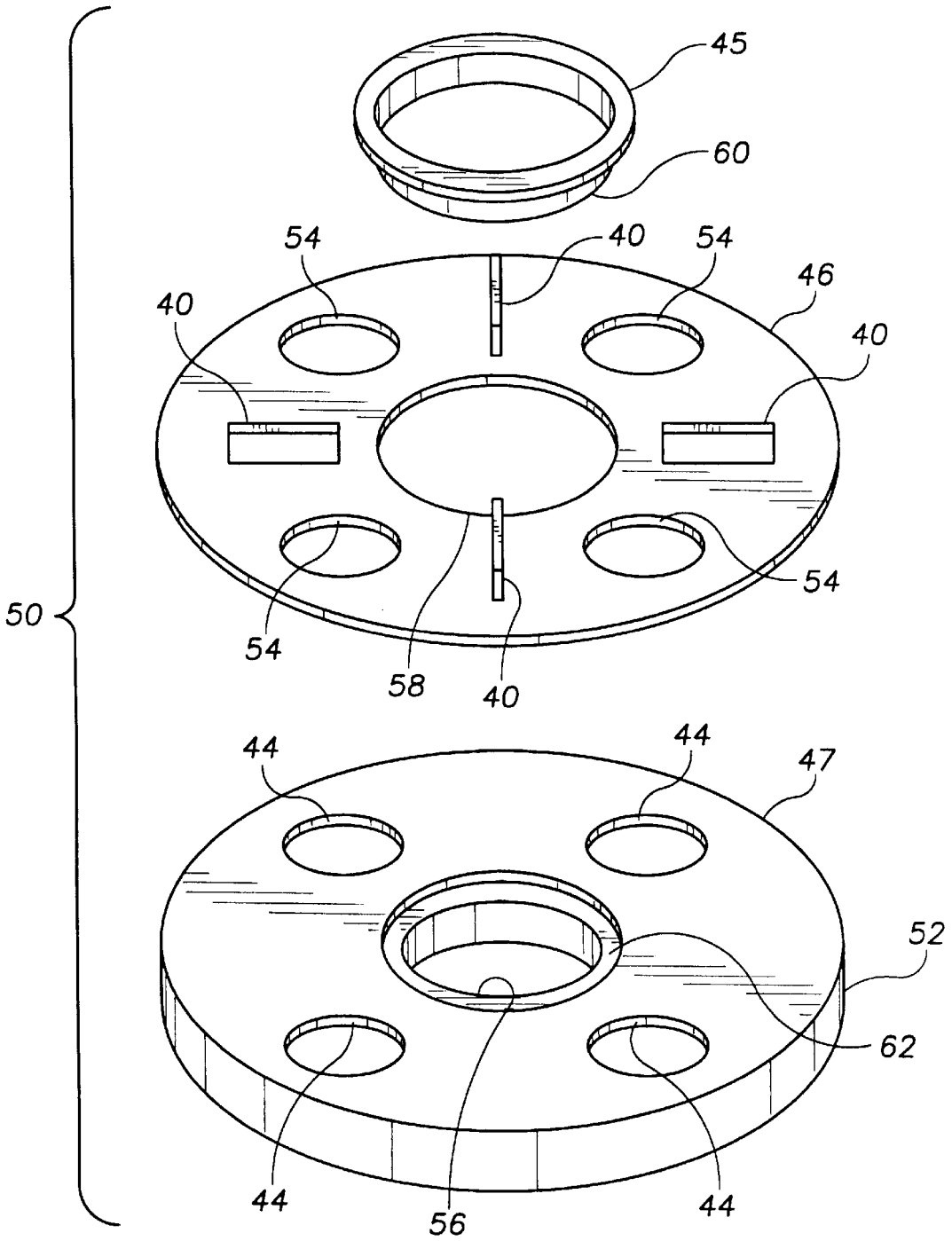
FIG. 1 is an exploded perspective top view of the adaptor base.
Figure 2:
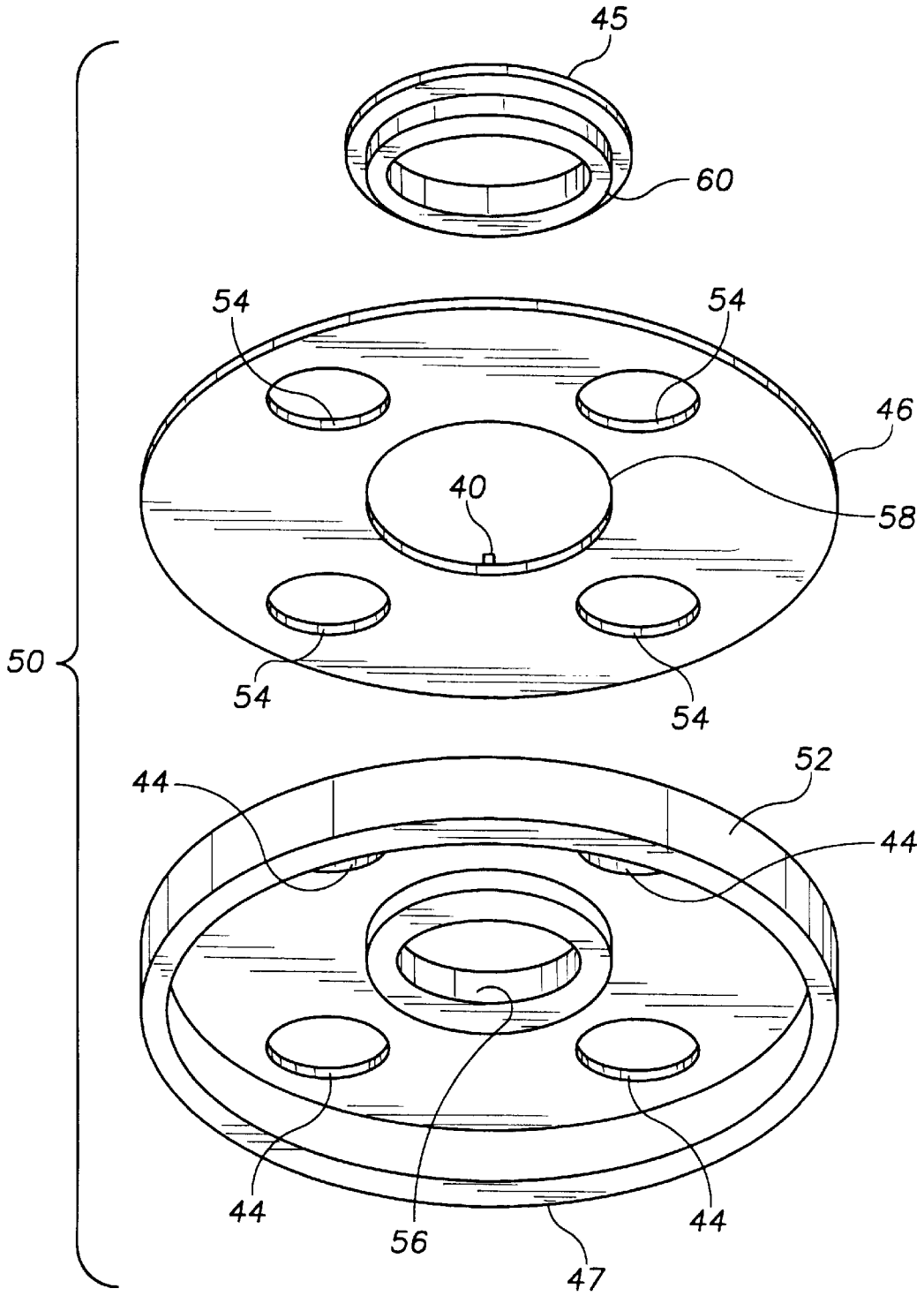
FIG. 2 is an exploded perspective bottom view of the adaptor base.

Referring to FIGS. 1 and 2, an adaptor base 50 has a lower housing 47 that is dimensioned to fit flush within a typical cylindrical swimming pool skimmer well (not shown). The contact between an edge 52 of housing 47 and the walls of the skimmer well is watertight. A rubber gasket (not shown) may optionally be used to ensure the watertight character of the contact between edge 52 and the walls of the skimmer well. Base 50 is preferably made of material that is lightweight, inexpensive, impermeable to water, and impervious to corrosion, such as polyvinyl chloride.

Housing 47 has housing holes or openings 44 and a central housing opening 56. A rotatable sealer plate 46 has plate holes or openings 54 and a central plate opening 58. Housing openings 44 and plate openings 54 preferably are dimensioned such that housing openings 44 are of the same diameter as plate openings 54. Central housing opening 56 and central plate opening 58 are of the same diameter as a lower edge 60 of a sealer ring 45. Lower edge 60 fits through central housing opening 56 and rests on housing upper edge 62 of housing 47. Thus, sealer plate 46 is held flush to housing 47 by the tight fitting mechanical interlock between sealer ring 45 and housing 47. The interlocked connection between housing 44, plate 46, and ring 45 is watertight.

Plate 46 has tabs 40 that extend orthogonally upward from plate 46. Tabs 40 provide the means for rotating plate 46 such that plate openings 54 are centered over housing openings 44 when the adaptor is in a open position i.e., water is able to enter the skimmer through housing openings 44. Similarly, when plate 46 is rotated such that no portion of plate openings 54 is aligned with any portion of housing openings 44, the adaptor is in a closed position, i.e. water is unable to enter the skimmer through housing openings 44.

Figure 3:
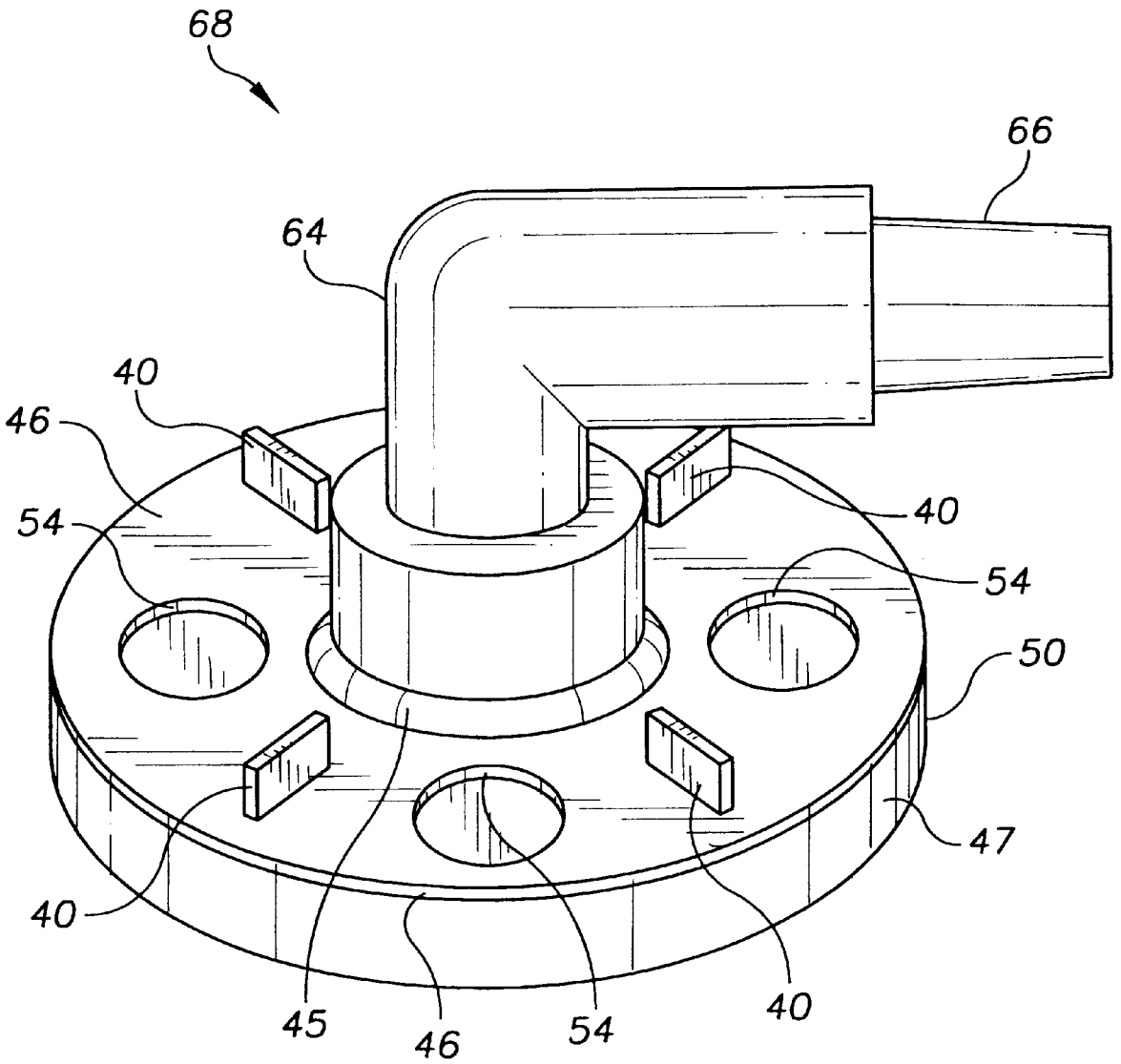
FIG. 3 is a side perspective view of the adaptor with the vacuum port in place, shown in a closed mode.

Referring to FIG. 3, a vacuum port 64 has been inserted into the assembled adaptor base 50 shown in the closed mode. The mechanical interlock between vacuum port 64 and base 50 is tight and waterproof. Vacuum port 64 may also be manufactured such that port 64 and base 50 are one-piece or integrally molded. A rubber gasket (not shown) optionally may be used to further ensure that this connection is waterproof A typical pool vacuum mouth end fits over hose connection 66 of vacuum port 64. The assembled adaptor 68 is shown in the closed position. No portion of plate openings 54 are aligned with any portion of housing openings 44. Hence, the suction within adaptor 68 is maintained and, once the mouth end of a vacuum pipe is attached to hose connection 66, the suction is immediately available for vacuuming the pool.

Figure 4:
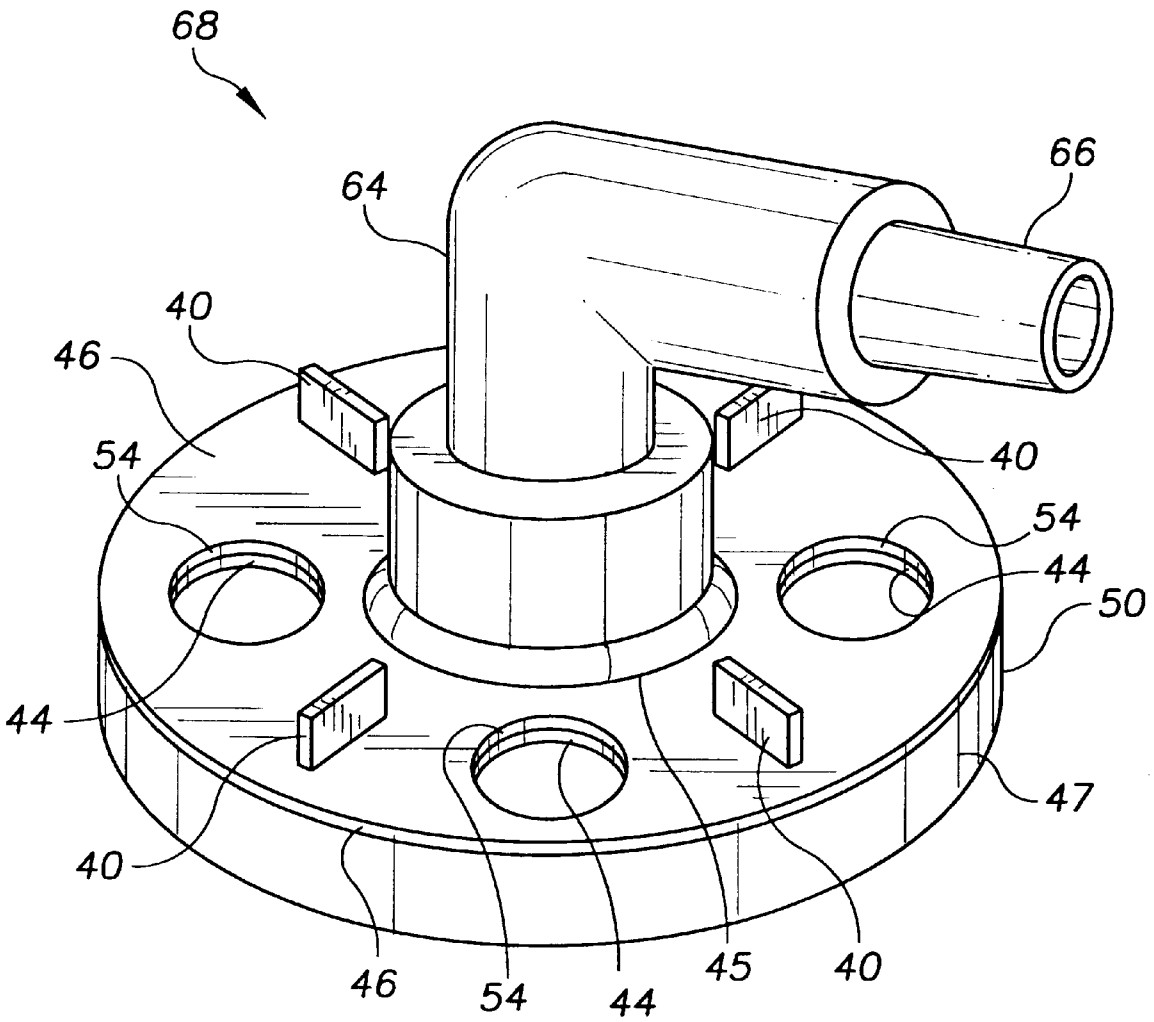
FIG. 4 is a side perspective view of the adaptor with the vacuum port in place, shown in an open mode.

In FIG. 4, the tabs are rotated such that plate openings 54 are centrally aligned over housing openings 44, placing the adaptor in an open mode. In this configuration, water is no longer entering adaptor 68 solely through vacuum port 64, thus rendering the pool vacuum ineffective and releasing the suction to allow removal of the adaptor. Tabs 40 may be rotated such that the adaptor is in a closed mode, as described above, if desired.

Accordingly, it is to be understood that the embodiments of the invention herein described are merely illustrative of the application of the principles of the invention. Reference herein to details of the illustrated embodiment are not intended to limit the scope of the invention.

What is claimed is:

1. An adaptor for a pool vacuum hose, permitting the hose to be attached in a pool skimmer well, the well having a suction port in a lateral wall, comprising:

a body having walls and an outer side, forming an interior volume with an open side, the body being sufficiently large such that the open side of the volume completely covers the suction port in the lateral wall, the walls of the body forming a watertight seal against the lateral wall of said skimmer well with the interior volume in communication with the suction port;

a connector for connecting a pool vacuum hose to said base, mounted upon the body, having a bore in communication with the interior volume; and a valve on the body, having an open position in which the interior volume of the body is in communication with the pool skimmer well, and a closed position;

such that when the open side of the body is placed over the suction port on the lateral wall, with the valve in the closed position, the body is held to the lateral wall by the suction from the suction port, and when the valve is in the open position the suction is released and the body may be removed.

2. The adaptor of claim 1, wherein:

the connector comprises a pipe passing through the body into the interior volume, forming a waterproof connection; and the end of the pipe opposite the body is dimensioned to form a waterproof connection to an end of a vacuum hose.

3. The adaptor of claim 1, wherein:

the valve comprises a plate, rotatably mounted on the connector, having at least one hole through the plate;

the outer side of the body has at least one hole passing through the side from the interior of the body, located completely under the plate of the valve and in such a location that when the plate is rotated around the connector, the hole in the plate can be brought into alignment with the hole in the outer side of the body, permitting flow through the outer side of the body into the interior volume and thus forming the open position of the valve.

4. The adaptor of claim 3, in which the plate of the valve further comprises at least one tab mounted upon the plate, on the side of the plate opposite the outer side of the body, for facilitating the rotation of the plate around the connector.

5. The adaptor of claim 3, in which the body has a plurality of holes.

6. The adaptor of claim 3, in which the plate has a plurality of holes.

* * * * *